United States Patent [19]

White

[11] 3,964,494

[45] June 22, 1976

[54] COMPOSITIONS FOR SMOKING

[75] Inventor: Jackie L. White, Pfafftown, N.C.

[73] Assignee: R. J. Reynolds Tobacco Company, Winston-Salem, N.C.

[22] Filed: Oct. 21, 1974

[21] Appl. No.: 516,743

[52] U.S. Cl. ..... 131/17 R; 131/2; 131/140 C; 131/140 P

[51] Int. Cl.[2] ..... A24B 3/14; A24B 13/00; A24B 15/08

[58] Field of Search ..... 131/2, 17 R, 15, 17, 131/140–144; 99/238

[56] References Cited

UNITED STATES PATENTS

| | | | |
|---|---|---|---|
| 52,976 | 3/1866 | Dawson | 131/2 |
| 3,100,492 | 8/1963 | Schmidt | 131/2 |
| 3,106,209 | 10/1963 | Torigian | 131/2 |
| 3,456,575 | 3/1966 | Mogi et al. | 99/238 |

FOREIGN PATENTS OR APPLICATIONS

| | | | |
|---|---|---|---|
| 687,507 | 3/1967 | Belgium | 131/2 |
| 1,113,979 | 5/1968 | United Kingdom | 131/2 |

OTHER PUBLICATIONS

"The Chemical Composition of Tobacco and Tobacco Smoke" by Stedman, p. 190, Eastern Utilization Research and Development Division, Res. Service, U.S.-D.A. Pennsyl. 19118 Reviewed 10/18/67.

Shmuk; vol. 3, of "The Chemistry and Technology of Tobacco" pp. 602–603; Publ. by Pishchepromizdat, Moscow, 1953.

"Dangerous Properties of Industrial Materials" by Sax, 3rd Edit. Publ. 1968, Reinhold Book Corp.

"Puffing-in-Perspective" pp. 17, 20 & 40 in Tobacco Reporter, Nov. 1969.

"Tobacco" vol. 166, No. 10, pp. 22–25, Mar. 8, 1968; "Composition of Cigarette Smoke from High and Low Nitrate Burley Tobacco" by Benner et al.

*Primary Examiner*—Robert W. Michell
*Assistant Examiner*—V. Millin
*Attorney, Agent, or Firm*—Neuman, Williams, Anderson & Olson

[57] ABSTRACT

Puffed milo is used alone or with tobacco to provide smoking materials.

11 Claims, No Drawings

COMPOSITIONS FOR SMOKING

This invention relates to novel smoking compositions and to products derived therefrom.

It is a principal object of this invention to provide a composition of matter which is advantageous for use as a smoking material.

It is another object of this invention to provide novel compositions containing tobacco which compositions can be used to form products such as cigarettes, cigars, pipe tobacco and the like.

The present invention involves the discovery that milo which is in an expanded condition and of relatively low density is eminently suitable for use as a smoking material.

In one embodiment, the invention provides smokable compositions comprising a mixture of tobacco and puffed milo. The puffed milo serves as a tobacco extender without significant effect on the organoleptic properties of tobacco products in which it is present. In a second embodiment of the invention, puffed milo is used alone or with other non-tobacco materials to form smoking materials.

The milo which is utilized as a smoking material in accordance with this invention is milo (*Sorghum vulgare*) which has been processed to expand its volume and decrease its density whereby it is in an expanded condition supportive of combustion. Processing of the milo to expand its volume involves puffing so as to produce a puffed milo of relatively low density. In general, the bulk density of the puffed milo employed herein is not greater than about 0.40 gram per cubic centimeter and preferably not greater than about 0.20 gram per cubic centimeter. The expression "puffed milo" as used herein means milo kernels which have been expanded to such extent that the bulk density is not greater than 0.40 gram per cubic centimeter when determined on a 12-mesh sample. For this determination of bulk density the milo is ground in a suitable mill and sieved to recover the 12-mesh (U.S. Sieve Series) portion thereof with a uniformly packed sample of known volume then being weighed.

The volume expansion of milo can be accomplished by puffing procedures well known to the art. As is known, puffing of milo can be accomplished by gun puffing which is the release of cereal pieces from a pressurized chamber or oven puffing where the cereal dough pieces are exposed suddenly to high temperatures. The oven method may involve exposure to radiant heat on a belt, tumbling in a heated rotating cylinder, exposure to heated rolls, or extrusion at high pressure and elevated temperature. Puffing of milo and other similar materials is a well developed art and there exist a number of patents relating to puffing processes and apparatus. Puffing of milo for use in accordance with this invention can be accomplished using known procedures and apparatus such as described in U.S. Pat. Nos. 3,456,575, 2,701,200, 2,231,387, 3,656,965, 3,703,379, 3,556,802, 3,392,660, 3,201,032, 3,660,110 and 3,682,651. After puffing, the puffed milo is separated from non-puffed kernels by conventional procedures such as screening, air classification and the like. The size and shape of the puffed milo which is used to form smoking materials is primarily dependent upon its intended use. It is generally preferred to grind, or more preferably shred, or otherwise comminute the puffed milo to a size and shape approximating that of the tobacco with which it is employed. Thus, when employed with tobacco to form cigarettes, the puffed milo is cut, sliced or shredded to a size and shape similar to the filler tobacco employed therewith. It is preferred to do likewise when the puffed milo is used with tobacco to form cigars or pipe smoking compositions.

When used with tobacco, puffed milo is blended with tobacco and the blend is then processed in conventional manner to form tobacco products. For example, puffed milo is shredded to a size approximating that of cut filler tobacco with which it is blended in desired proportion. The blend is then processed in conventional cigarette making machines to form cigarettes which can be either of the filter or nonfilter type. Additive materials such as flavorants, humectants, ash improvers, combustion modifiers, fillers and the like can be incorporated with the tobacco/puffed milo blends. Pipe or smoking tobacco products can be readily produced by simply blending the puffed milo with tobacco and flavorants, if any.

It will be appreciated that the use of puffed milo with tobacco serves to extend the tobacco or reduce the amount of tobacco employed in a product with a concommitant decrease in the amount of nicotine therein. This is achieved without adverse effect on the taste or aroma of the final product. The amount of the puffed milo which is blended with tobacco can vary widely up to about 50% or more by volume of the tobacco.

According to a second embodiment of the invention, puffed milo is employed as a tobacco substitute by itself or with other non-tobacco materials to form smoking products such as cigarettes, cigars and pipe smoking products. When so used, it is presently preferred that the puffed milo simulate tobacco and accordingly appropriate procedures can be employed to provide the puffed milo in desired size and shape. The burning rate, flavor and other properties of non-tabacco smoking products can be altered by incorporating with the puffed milo suitable additives such as flavorants, tobacco extracts, nicotine, humectants, ash improving additives, etc. The burning rate of puffed milo is somewhat faster than most natural tobaccos and accordingly, to decrease the burning rate of non-tobacco smoking products, suitable filler materials or combustion modifiers such as magnesium carbonate, calcium carbonate, potassium carbonate, sodium carbonate, magnesium nitrate, calcium nitrate and the like can be incorporated with the puffed milo. The materials which are used with the puffed milo to form smoking products are employed in amounts depending upon the effects desired.

When used with or without tobacco to form smoking materials, the puffed milo is preferably conditioned to a moisture content of say from 6 to 15%, at which moisture content the material is well adapted for processing to form smoking products.

The following examples illustrate the advantages of the present invention. In the examples the bulk density of the tobacco extender of this invention was determined by weighing a known volume of the puffed milo as indicated. However, in all cases the bulk density of the materials is less than 0.40 gram per cubic centimeter when determined on a 12-mesh sample thereof.

EXAMPLE 1

Bulk density measurements were made on whole puffed milo which had been previously stored at 50 to 60% relative humidity until an equilibrium moisture content of 8 to 10% was reached. The puffed milo was then ground in a Waring blender and sieved. Various particle sizes were collected and the bulk densities thereof were determined by weighing a 50 cubic centimeter volume of uniformly packed material. The packing was accomplished by rapping the bottom of the container frequently during the packing operation so that the particles settled evenly. No external pressure was applied to the mass of particles in making this measurement. The densities of the materials retained on various mesh screens are shown in Table I. For comparison purposes, the densities of selected tobacco materials are shown in Table II.

TABLE I

| Material Retained on U.S. Standard Sieve Series | Bulk Density (g/cc) |
|---|---|
| No. 8 | 0.0417 |
| No. 12 | 0.0399 |
| No. 14 | 0.0408 |
| No. 16 | 0.0418 |
| No. 20 | 0.0448 |
| No. 30 | 0.0519 |

TABLE II

| Sample | Bulk Density |
|---|---|
| Puffed Flue-Cured Tobacco* | 0.07 g/cc |
| Reconstituted Tobacco | 0.19 g/cc |
| Commercial cigarette blend without casing or top dressing | 0.11 g/cc |

*Puffed in accordance with U.S. Pat. No. 3,524,451

These tests demonstrate that the puffed milo smoking material is highly expanded and low in bulk density when compared to tobacco commonly used for filling cigarettes.

EXAMPLE 2

The filling capacity of puffed milo was determined. Puffed milo was cut in 32 shreds per inch and was very much like tobacco shreds with fines being first removed through the use of a No. 14 U.S. Standard Sieve.

In order to measure the filling capacity of a cigarette filler material, a measuring device is used which is essentially composed of a 100 milliliter graduated cylinder having an internal diameter of about 25 millimeters and a piston having a diameter of about 24 millimeters and weighing about 802.5 grams slidably positioned in the cylinder. A 3-gram sample of the material is placed in the cylinder and the piston positioned on it. The gravitational force exerted by the piston corresponds to a pressure of about 2.3 pounds per square inch. The filling value of the sample is the volume to which the 3-gram sample of the material in the cylinder is compressed after the weight of the piston has acted on it for a period of 3 minutes. This pressure corresponds closely to the pressure normally applied by the wrapping paper to the tobacco in cigarettes. By this procedure the filling capacity of the puffed milo was found to be 59 milliliters per 3-gram sample at a moisture content of 8.64%.

EXAMPLE 3

Cigarettes were prepared from shredded puffed milo by blending either 20% or 50% by volume of the shredded milo with 80% or 50% by volume of a commercial cigarette tobacco. The tobacco-puffed milo blend was then manufactured into cigarettes using Ecusta Ref. 853 paper. The resulting 65-millimeter tobacco rods were combined with 20 millimeters of a 3.3/39,000 cellulose acetate filter and the finished filter cigarettes were smoked under standard FTC conditions to give the following results:

| Rod Composition | Rod Weight (g.) | TPM* (mg.) | Nicotine (mg.) | FTC** Tar (mg.) |
|---|---|---|---|---|
| All Tobacco | 0.83 | 23.1 | 1.32 | 17.8 |
| 20% (vol.) Extender] 80% (vol.) Tobacco] | 0.71 | 21.0 | 1.05 | 15.8 |
| 50% (vol.) Extender] 50% (vol.) Tobacco] | 0.52 | 19.6 | 0.76 | 14.1 |

*Total Particulate Matter

**As determined by standard procedures of Federal Trade Commission.

In addition to machine smoking under standard FTC conditions, cigarettes containing 20% by volume of the shredded puffed milo were also smoked by expert panelists in comparison with an all tobacco control cigarette. The majority of the panelists detected no difference in harshness, offtaste or sidestream aroma.

EXAMPLE 4

A solution of 1.73 grams of magnesium nitrate hexahydrate in 5 milliliters of water was sprayed onto 19 grams of shredded puffed milo. The puffed milo was then treated in a similar manner with a solution of 0.5 gram potassium carbonate in 4 milliliters of water. The treated puffed milo was allowed to air-dry and was then made into 70-millimeter cigarettes using a small Hauni cigarette making machine and Ecusta 853 paper. The average weight of the cigarettes was 0.28 gram and the average pressure drop across the 70-millimeter rod was 0.94 inches of water. The average number of puffs obtained from each cigarette when machine smoked under standard FTC conditions (i.e., one 35-milliliter puff of 2-second duration every 60 seconds until a butt length of 23 millimeters is reached) was 2.5.

The use of puffed milo with tobacco to produce useful products possesses numerous advantages. Thus, use thereof permits a significant reduction in the utilization of tobacco. Not only is the use of less tobacco in a tobacco product obviously advantageous from an economic standpoint, but the reduction of nicotine in such products may be highly desirable. The reduction of so-called "tars" may also be realized through the use of puffed milo in smoking products since particulate matter produced per unit volume of puffed milo is substantially less than that for tobacco due to the significantly lower density of puffed milo. The nicotine-free puffed milo, when blended with tobacco, does not cause adverse effects on the quality of the final product. The puffed milo is easily processed, readily available at relatively low cost and does not detract from the taste or aroma of the tobacco product. The puffed milo is non-friable in nature, does not collapse as a cigarette is smoked nor does it hinder combustion or puffing of cigarettes in which it is employed.

Those modifications and equivalents which fall within the spirit of the invention are to be considered a part thereof.

What is claimed is:

1. A smoking material which contains comminuted puffed milo in a form resembling cut cigarette filler tobacco or cut pipe tobacco.

2. A smoking material in accordance with claim 1 wherein the puffed milo is in the form of shreds.

3. A smoking material in accordance with claim 1 which also contains tobacco.

4. A smoking material in accordance with claim 3 wherein the puffed milo is employed in an amount up to 50% by volume of the tobacco.

5. A cigarette whose filler contains comminuted puffed milo in a form resembling cut cigarette filler tobacco.

6. A cigarette in accordance with claim 5 wherein the puffed milo is in the form of shreds.

7. A cigarette in accordance with claim 5 whose filler also contains tobacco.

8. A cigarette in accordance with claim 7 wherein the puffed milo is employed in an amount up to 50% by volume of the tobacco.

9. A process of preparing a cigarette which comprises wrapping with a cigarette paper a filler material containing comminuted puffed milo in a form resembling cut cigarette filler tobacco.

10. A process in accordance with claim 9 wherein the puffed milo is in the form of shreds.

11. A process in accordance with claim 9 wherein said filler material also contains tobacco.

* * * * *